US008157340B2

(12) United States Patent
Morton et al.

(10) Patent No.: US 8,157,340 B2
(45) Date of Patent: Apr. 17, 2012

(54) APPARATUS AND METHOD FOR THERMAL PRINTERS THAT EMPLOY A BATTERY OR OTHER PORTABLE POWER SOURCE

(75) Inventors: Bruce McKay Morton, Lake Stevens, WA (US); Hans Nordström, V. Frolunda (SE); Börje Gillholm, Kungsbacka (SE)

(73) Assignee: Intermec IP Corp., Everett, WA (US)

( * ) Notice: Subject to any disclaimer, the term of this patent is extended or adjusted under 35 U.S.C. 154(b) by 1481 days.

(21) Appl. No.: 11/617,622

(22) Filed: Dec. 28, 2006

(65) Prior Publication Data

US 2008/0117244 A1 May 22, 2008

Related U.S. Application Data

(60) Provisional application No. 60/866,829, filed on Nov. 21, 2006.

(51) Int. Cl.
*B41J 29/38* (2006.01)
*B41J 2/35* (2006.01)

(52) U.S. Cl. ..... 347/5; 347/211

(58) Field of Classification Search ..... 347/5
See application file for complete search history.

(56) References Cited

U.S. PATENT DOCUMENTS

| | | | | | |
|---|---|---|---|---|---|
| 4,360,819 | A * | 11/1982 | Saito et al. | 347/180 |
| 4,409,600 | A * | 10/1983 | Minowa | 347/211 |
| 4,656,489 | A * | 4/1987 | Sato et al. | 347/182 |
| 4,843,300 | A * | 6/1989 | Alderman | 323/224 |
| 5,469,068 | A * | 11/1995 | Katsuma | 324/678 |
| 5,633,671 | A * | 5/1997 | Watanabe | 347/192 |
| 5,638,421 | A * | 6/1997 | Serrano et al. | 379/32.04 |
| 5,691,630 | A * | 11/1997 | Chosa | 323/267 |
| 5,805,433 | A * | 9/1998 | Wood | 363/16 |
| 6,149,062 | A | 11/2000 | Danielson et al. | |
| 6,199,969 | B1 | 3/2001 | Haflinger et al. | |
| 6,724,411 | B2 * | 4/2004 | Reele | 347/174 |
| 6,837,558 | B2 * | 1/2005 | Kaburagi | 347/5 |
| 2005/0174369 | A1 * | 8/2005 | Masuda | 347/5 |

FOREIGN PATENT DOCUMENTS

| | | | |
|---|---|---|---|
| JP | 61-264861 | | 11/1986 |
| JP | 63-31768 | | 2/1988 |
| JP | 10297009 | A * | 11/1998 |
| JP | 11179950 | A * | 7/1999 |

OTHER PUBLICATIONS

"Intermec PB42 Portable Printer," URL=http://www.intermec.com/eprise/main/Intermec/Content/Products/ Products_ ShowDetail?Product=PRTRPB42#, download date Apr. 9, 2007, pp. 1-3.

"Zebra 420," URL=http://www.zebra.com/id/zebra/na/en/index/products/printers/mobile/ql420.1.tabs.html, download date Apr. 9, 2007, pp. 1-3.

* cited by examiner

*Primary Examiner* — Shelby Fidler
(74) *Attorney, Agent, or Firm* — Seed IP Law Group PLLC

(57) ABSTRACT

A thermal printer includes a capacitor and a power converter operable to step a voltage of a power source, and coupled to charge the capacitor. Printing is controlled based at least in part on a charge state of the capacitor. Delays in charging the capacitor may be avoided where a current line of print data is blank. Operation may be curtailed where the voltage of the power source is below a threshold.

28 Claims, 4 Drawing Sheets

APPARATUS AND METHOD FOR THERMAL PRINTERS THAT EMPLOY A BATTERY OR OTHER PORTABLE POWER SOURCE

CROSS-REFERENCE TO RELATED APPLICATION

This application claims the benefit under 35 U.S.C. §119 (e) of U.S. Provisional Patent Application No. 60/866,829 filed Nov. 21, 2006, which application is incorporated herein by reference in its entirety.

BACKGROUND OF THE INVENTION

1. Field of the Invention

This description generally relates to the field of thermal printers, and more particularly to thermal printers that employ a portable power source, for example one or more batteries.

2. Description of the Related Art

Thermal printers produce a printed image by selectively forming a number of marks (e.g., dots) on a thermal paper or on other media via a thermal transfer ribbon. The marks are produced by a plurality of resistive elements of a thermal print head which heat the thermal paper or thermal ribbon to form successive lines. The lines ultimately form a desired image.

Existing battery operated thermal printers limit the number of resistive elements that are active at any given time to avoid overloading the power source (e.g., chemical battery) that powers such thermal printers. If the number of marks to be formed on a line exceeds the limit on the number of resistive elements that may be active at one time, then the resistive elements may be strobed in separate segments. However, strobing the resistive elements in segments may produce undesirable results. For example, such may cause steps in the lines due to movement of the media.

During use, the power source voltage may be reduced due to the electrical load of the thermal print head. A reduction in power source voltage may be compensated for by strobing the resistive elements of the print head for a longer time. Increasing the strobe time causes the resistive elements to emit more energy, thereby resulting in darker marks. However, increasing strobe time may cause the marks to be larger than otherwise desired. For example, some dots may have a larger diameter than other dots. Additionally, increasing strobe time reduces the speed at which the thermal printer operates. Reduced power source voltage may also disadvantageously limit the number of devices (e.g., resistive elements, motors and/or displays) that can be powered by the battery during use.

It is therefore desirable to have a new method and apparatus that addresses or alleviates at least some of the above stated problems.

BRIEF SUMMARY OF THE INVENTION

According to one aspect, a thermal printer includes a thermal print head, a capacitor selectively coupleable to supply power stored in the capacitor to the thermal print head, means for stepping a voltage from a power source and supplying the stepped voltage to the capacitor and the thermal print head.

According to another aspect, a thermal printer includes a thermal print head, a capacitor selectively coupleable to supply power stored in the capacitor to the thermal print head, and a power converter operable to step a voltage from a power source and to supply the stepped voltage to the capacitor and the thermal print head.

According to yet another aspect, a method of operating a thermal printer includes stepping a voltage from a power source, supplying the stepped voltage to a capacitor, and selectively supplying current from the capacitor to a thermal print head of the thermal printer.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE INVENTION

In the following description, certain specific details are set forth in order to provide a thorough understanding of various embodiments of the invention. However, one skilled in the art will understand that the embodiments may be practiced without these details. In other instances, well-known structures, equipment and processes associated with thermal printing devices, including thermal printer heads (TPHs), power converters, motors, stepper motors, stepper motor drivers, and controllers have not been shown or described in detail to avoid unnecessarily obscuring the description.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combinable in any suitable manner in one or more embodiments.

As used in this specification and the appended claims, the singular forms "a," "an," and "the" include plural referents unless the content clearly dictates otherwise. It should also be noted that the term "or" is generally employed in its sense including "and/or" unless the content clearly dictates otherwise.

The headings provided herein are for convenience only and do not interpret the scope or meaning of the claimed invention.

Figure 1:
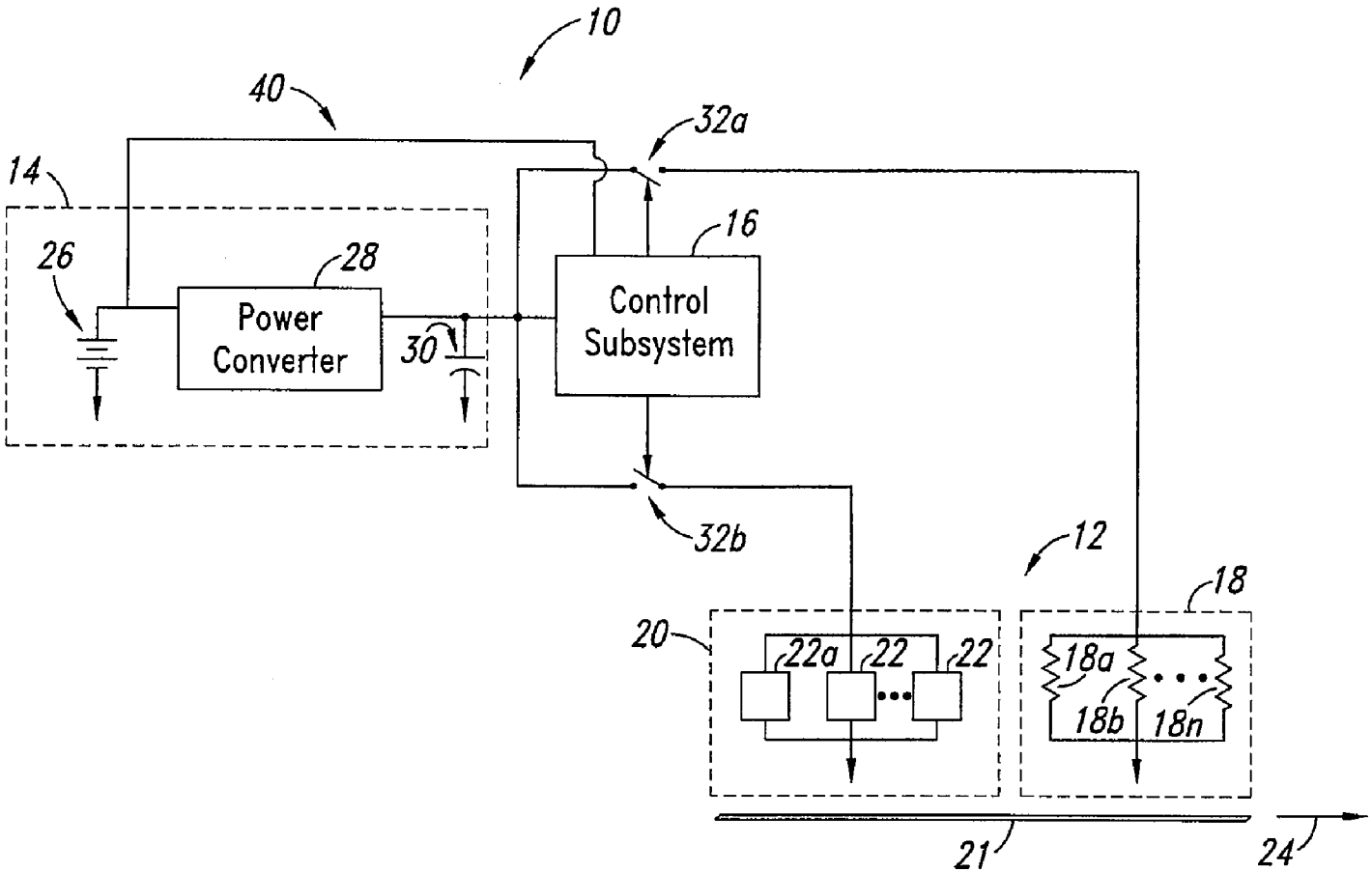
FIG. 1 is a schematic illustration of a thermal printer, according to one illustrated embodiment.

FIG. 1 shows a thermal printer 10, according to one illustrated embodiment.

The thermal printer 10 may include a printing subsystem 12, a power supply subsystem 14, and a control subsystem 16.

The printing subsystem 12 may include one or more thermal print heads 18 and a media drive subsystem 20. The thermal print head 18 includes a plurality of resistive elements 18*a*-18*n* which are selectively individually actuatable to produce heat. In particular, current may be applied to selected ones of the resistive elements 18*a*-18*n*. The current may be applied by strobing across the array of resistive elements 18*a*-18*n*. Heat generated by the resistive elements 18*a*-18*n* cause proximate portions of thermal paper or thermal transfer ribbon to warm, and form a mark on a piece of media 21.

The media drive subsystem 20 may include one or more actuators 22 for advancing media 21 (e.g., thermal paper, paper, thermal transfer ribbon) through the thermal printer along a media path (indicated by arrow 24), past the thermal print head 18. The actuator 22 may, for example, take the form of one or more motors, for example one or more stepper motors 22*a*. The media path 24 may be defined by one or more rollers (e.g., driven or freewheeling rollers, pickup rollers, etc.), platens (e.g., fixed or movable), guides, and/or other structures.

The power supply subsystem 14 may include a power source 26, a power converter 28 and one or more capacitors 30 operable to store and release charge.

The power source 26 may, for example, take the form of an energy storage device, such as an array of battery cells and/or a super capacitor. Alternatively, or additionally, the power source 26 may, for example, take the form of an energy producing device such as an array of fuel cells or photovoltaic cells. The power source 26 may also take the form of an AC adaptor. The AC adaptor may have a substantially small output voltage which would prevent direct connection to the thermal print head 18 or have an output voltage that is not compatible with the thermal print head 18. The power source 26 may advantageously be a portable power source, allowing the thermal printer 10 to be mobile.

The power converter 28 is operable to step up or step down the voltage from the power source 26 and supply the stepped up or stepped down voltage to one or more capacitors 30. Consequently, the power converter 28 may take the form of a DC/DC converter, operable to produce a stepped up or stepped down DC voltage from a DC power source. The power converter 28 may take a variety of forms. For example, the power converter 28 may take the form of a passive power converter or, alternatively, a switch mode power converter. In at least one embodiment, the power converter 28 takes the form of a current regulated power converter.

The capacitor 30 stores and releases charge to power the printing subsystem 12. For example, the capacitor 30 may store sufficient charge to supply power to heat an entire line of resistive elements 18*a*-18*n* all at the same time. In some embodiments, the capacitor 30 may store sufficient charge to supply power to the actuator 22 (e.g., stepper motor 22*a*), as well as to heat the entire line of resistive elements 18*a*-18*n* at the same time. In some embodiments, the capacitor 30 may also provide power for other elements of the thermal printer 10, for example for the control subsystem 16.

The capacitor 30 can take a variety of forms. For example, the capacitor 30 may take the form of an electrolytic capacitor (e.g., a can capacitor) or may take the form of film capacitor or other type of capacitor. The capacitor 30 may take the form of one or more super- or ultra-capacitors.

The control subsystem 16 is configured to control operation of the thermal printer 10, and in particular to control operation of the printing subsystem 12. In particular, the control subsystem 16 may be configured to control the printing subsystem 12 based at least in part on a charge state of the capacitor 30. Such operation is discussed in detail below with reference to FIG. 3.

The control subsystem 16 may control the thermal print head 18 and the media drive subsystem 20 via signals and/or via respective switches 32*a*, 32*b* (collectively referenced as 32) that provide an electrical connection to the capacitor 30 when in the CLOSED position and a disconnection from the capacitor 30 when in the OPEN position. The control subsystem 16 may control the respective switches 32 to selectively allow the thermal print head 18 and/or the actuator 22 to draw current from the capacitor 30. The switches 32 may take a variety of forms, for example discrete switches (e.g., relays, contactors, etc.) or integrated switches (e.g., MOSFETs, IGBTs).

Figure 2:
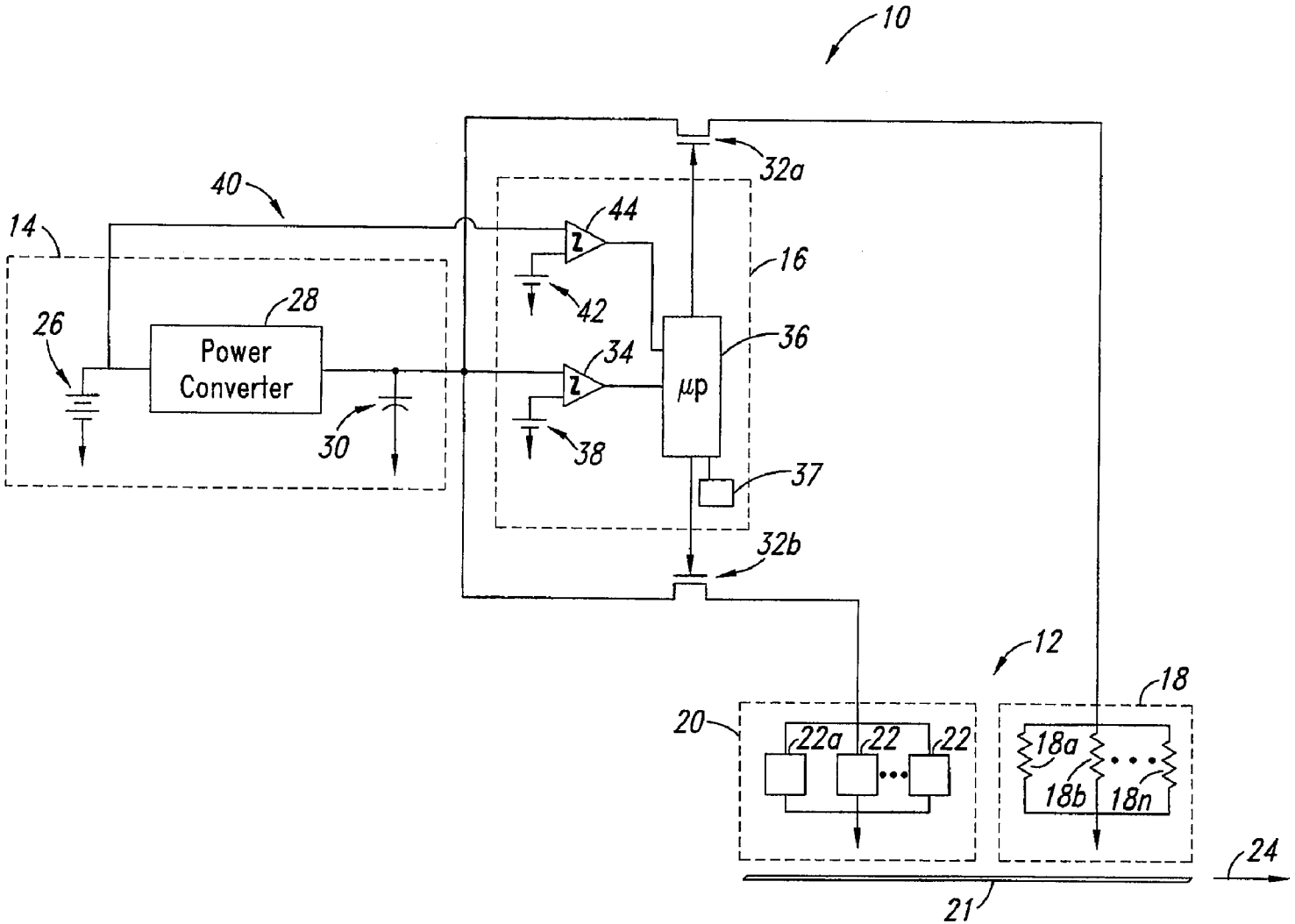
FIG. 2 is a schematic illustration of a thermal printer including a comparator, a microprocessor and one or more memories, according to one illustrated embodiment.

FIG. 2 shows the thermal printer 10 with the control subsystem 16 according to one illustrated embodiment.

In the embodiment illustrated in FIG. 2, the control subsystem 16 includes a comparator 34, a microprocessor 36 and one or more memories 37.

The comparator 34 may be coupled to receive a signal indicative of the charge state of the capacitor 30 and to receive a signal indicative of a capacitor charge threshold 38 (e.g., 22V). The capacitor charge threshold 38 is indicative of the charge that is sufficient to either assure that all resistive elements 18*a*-18*n* in a line of the thermal print head 10 may be powered at the same time and/or to assure that the actuator 22 may be powered as well as powering all resistive elements 18*a*-18*n* in the line of the thermal print head 18 at the same time. The comparator 34 is configured to compare the charge state of the capacitor 30 to the capacitor charge threshold 38 and produce a corresponding signal indicative of a result of the comparison.

The capacitor charge threshold 38 may, for example, be determined during manufacturing of the thermal print head 18. The capacitor charge threshold 38 substantially assures that the line of resistive elements 18*a*-18*n* are sufficiently powered to print the entire line without having to vary a print speed (e.g., 2 inch/second) of the thermal printer 10 to compensate for a lack of sufficient power supplied to the thermal print head 18. For example, to compensate for a reduced voltage applied to the thermal print head 18, the print speed may otherwise have to be reduced since additional time is needed to transfer sufficient energy to the media 21 to create the line of marks. Thus, maintaining the charge state of the capacitor 30 above the capacitor charge threshold 38 allows the print speed of the thermal printer 10 to remain substantially constant throughout operation.

The microprocessor 36 is coupled to receive the signal indicative of the result of the comparison. As explained in more detail below with reference to FIG. 3, the microprocessor 36 may be configured to enable the thermal print head 18 to print the entire line in response to the signal indicating that the charge state of the capacitor 30 is above the capacitor charge threshold 38. Additionally, the microprocessor 36 may control the actuator 22 (e.g., stepper motor 22*a*) to advance the media 21 with respect to the print head 18 so that the subsequent line may be printed thereafter. The microprocessor 36 enables the thermal print head 18 and/or the actuator 22 by allowing a supply of current to be drawn from the capacitor 30 by the thermal print head 18 and/or to the actuator 22 (e.g., stepper motor 22*a*). The microprocessor 36 may allow the supply of current to be drawn from the capacitor 30 by closing at least one of the respective switches 32. Also as explained in more detail below with reference to FIG. 3, the microprocessor 36 may be configured to delay the printing until the charge state of the capacitor 30 is above the capacitor charge threshold 38.

The memory 37 may store instructions and/or data for execution or use by the microprocessor 36, and may store print data indicative of the marks to be printed on the media 21. The memory 37 may take a variety of forms, including but not limited to one or more random access memories (RAMs), read only memories (ROMs), static memories, and/or dynamic memories.

The control subsystem 16 may further include a power source voltage feedback circuit 40 operable to stop a draw of current from the power source 26 when a voltage of the power source 26 drops below a power source voltage threshold 42. The voltage feedback circuit 40 may include the microprocessor 36, which may be configured to provide an appropriate signal based on a comparison of the power source voltage to the power source voltage threshold 42.

Figure 3:
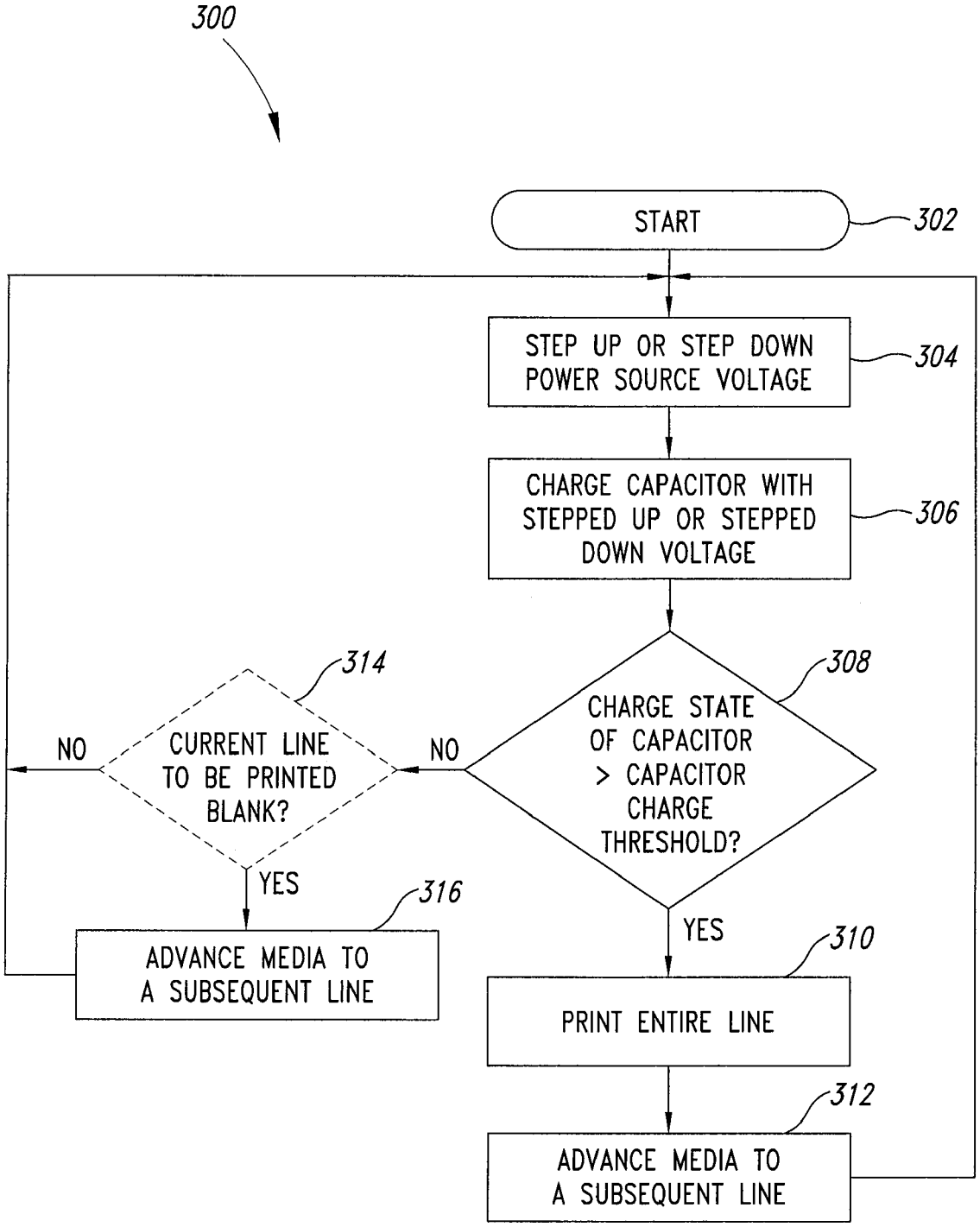
FIG. 3 is a flow diagram of a method of operating a thermal printer, according to one illustrated embodiment in which printing is controlled based at least in part on a charge state of a capacitor.

FIG. 3 shows a flow diagram of a method 300 of operating the thermal printer 10, according to one illustrated embodiment.

The method 300 starts at 302, for example in response to an activation of the power source 26. At 304, the power converter 28 steps up or steps down the voltage from the power source 26.

At 306, the capacitor 30 is charged using the stepped up or stepped down voltage from the power converter 28. As noted above, the charge stored in the capacitor 30 should be sufficiently large to supply power to heat the entire line of resistive elements 18*a*-18*n* of the thermal print head 18 at the same time, as well as to operate the actuator 22.

At 308, the control subsystem 16 compares the charge state of the capacitor 30 with the capacitor charge threshold 38. In response to an indication that the charge state of the capacitor 30 is above the capacitor charge threshold 38, control passes to 310. In response to an indication that the charge state of the capacitor 30 is not above the capacitor charge threshold 38, control passes to 314.

At 310, in response to an indication that the charge state of the capacitor 30 is above the capacitor charge threshold 38, the control subsystem 16 activates the thermal print head 18 to print the entire line on the media 21. In particular, the control subsystem 16 activates selected ones of the resistive elements 18*a*-18*n* of the thermal print head 18 to print the entire line on the media 21. For example, the control subsystem 16 may provide a strobe signal to the print head 18 with a number of the resistive elements 18*a*-18*n* selected. At 312, the control subsystem 16 activates the actuator 22 (e.g., stepping stepper motor 22*a*) to advance the media 21 so that a subsequent line may be printed thereafter. The method 300 returns control to 304 to handle the next line of print data.

In response to an indication that the charge state of the capacitor 30 is not above the capacitor charge threshold 38, the control subsystem 16 does not activate the thermal print head 18. Optionally, the control subsystem 16 determines whether the current line of print data to be printed is blank at 314. If the current line of print data is blank, control passes to 316, where the control subsystem 16 activates the actuator 22 (e.g., step stepper motor 22*a*) to advance the media 21 to the subsequent line and returns control to 304. This reduces the amount of time spent waiting for the capacitor 30 to charge. Otherwise, if the current line of print data is not blank, control passes directly to 304. In passing control directly back to 304, the control subsystem 16 does not advance the media 21 to the subsequent line, thereby delaying the printing of the line until the charge state of the capacitor 30 is above the capacitor charge threshold 38.

Figure 4:
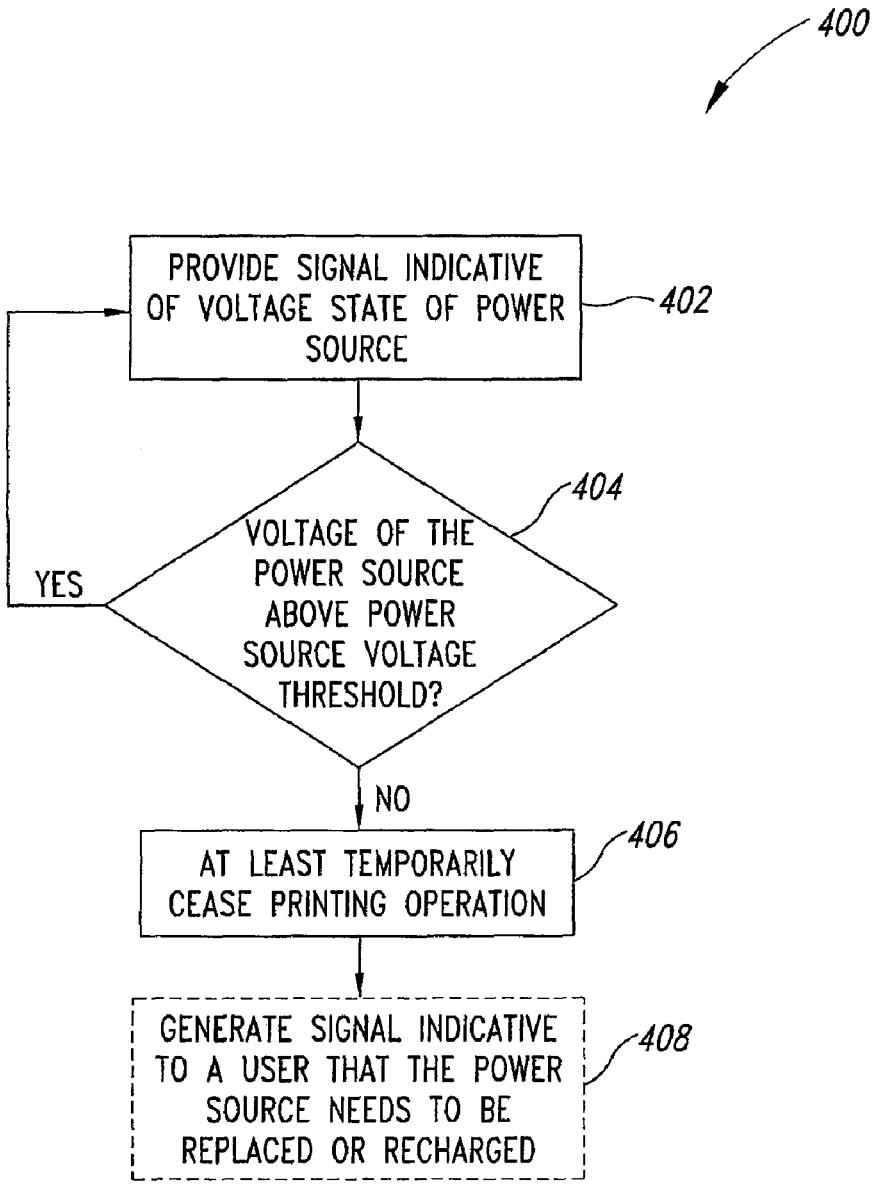
FIG. 4 is a flow diagram of a method of operating a thermal printer, according to another illustrated embodiment in which operation is controlled based at least in part on a voltage state of a power source.

FIG. 4 shows a method 400 of operating the thermal printer 10 according to another illustrated embodiment. The method 400 may be a concurrent or sequential thread or process of the method 300 (FIG. 3), or may be integrated into the method 300.

At 402, a signal indicative of a voltage state of the power source 26 is provided to the comparator 44. At 404, the comparator 44 determines whether the voltage of the power source 26 is above the power source voltage threshold 42. If the voltage of the power source 26 is above the power source voltage threshold 42, control returns to 402. If the voltage of the power source 26 is not above the power source voltage threshold 42, operation of printing is at least temporarily ceased at 406. Optionally at 408, the microprocessor 36 may cause a signal to be provided indicating to a user that the power source 26 needs to be replaced or recharged.

The methods 300 and 400 may include additional acts, may omit some of the above-described acts and/or perform acts in a different order than set out in the flow diagram.

All of the above U.S. patents, U.S. patent application publications, U.S. patent applications, foreign patents, foreign patent applications and non-patent publications referred to in this specification and/or listed in the Application Data Sheet, are incorporated herein by reference, in their entirety.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A thermal printer comprising:

a thermal print head;

a capacitor selectively coupleable to supply power stored in the capacitor to the thermal print head;

means for stepping a voltage from a power source and supplying the stepped voltage to the capacitor;

means for supplying the stepped voltage to the thermal print head; and a comparison circuit configured to produce a signal indicative of a comparison between a charge state of the capacitor and a capacitor charge threshold;

a control subsystem configured to cause the thermal print head to print if the signal has a first value, the control subsystem further configured to cause the motor to step if the signal has a second value and if a current line of print data is blank.

2. The thermal printer of claim 1 wherein means for stepping the voltage includes means for stepping up the voltage from the power source.

3. The thermal printer of claim 1 wherein means for stepping the voltage includes means for stepping down the voltage from the power source.

4. The thermal printer of claim 1 wherein the capacitor is sufficiently large to supply power to an entire line of resistive elements of the thermal print head simultaneously.

5. The thermal printer of claim 1, wherein the comparison circuit includes a comparator coupled to compare the charge state of the capacitor to a capacitor charge threshold and configured to produce a signal indicative of a result of the comparison.

6. The thermal printer of claim 1, wherein the control subsystem includes a microprocessor coupled to receive the signal indicative of the result of the comparison, the microprocessor configured to cause the thermal print head to print in response to the charge state of the capacitor being above the capacitor charge threshold.

7. A thermal printer comprising:

a thermal print head;

a capacitor selectively coupleable to supply power stored in the capacitor to the thermal print head;

a power converter operable to step a voltage from a power source and to supply the stepped voltage to the capacitor;

a switch operable to couple the capacitor to the thermal print head;

a comparison circuit configured to produce a signal indicative of a comparison between a charge state of the capacitor and a capacitor charge threshold;

a control subsystem configured to cause the thermal print head to print if the signal has a first value, the control subsystem further configured to cause the motor to step if the signal has a second value and if a current line of print data is blank.

8. The thermal printer of claim 7 wherein the capacitor is sufficiently large to supply power to an entire line of resistive elements of the thermal print head simultaneously.

9. The thermal printer of claim 7 wherein the control subsystem is configured to control at least the thermal print head based at least in part on the charge state of the capacitor.

10. The thermal printer of claim 9, wherein the comparison circuit includes a comparator coupled to compare the charge state of the capacitor to the capacitor charge threshold and configured to produce the signal indicative of the result of the comparison.

11. The thermal printer of claim 10, wherein the control subsystem includes a microprocessor coupled to receive the signal indicative of the results of the comparison, the microprocessor configured to cause the thermal print head to print in response to the charge state of the capacitor being above the capacitor charge threshold.

12. The thermal printer of claim 11 wherein the microprocessor is further configured to delay printing in response to the charge state of the capacitor not being above the capacitor charge threshold.

13. The thermal printer of claim 11 further comprising:

a motor selectively operable to move media with respect to the thermal print head.

14. The thermal printer of claim 13 wherein the capacitor is sufficiently large to supply power to the motor and to an entire line of resistive elements of the thermal print head simultaneously.

15. The thermal printer of claim 13 wherein the motor is a stepper motor.

16. The thermal printer of claim 15 wherein the microprocessor is coupled to control the stepper motor and is configured to cause the stepper motor to step in response to the charge state of the capacitor being greater than the capacitor charge threshold.

17. The thermal printer of claim 15 wherein the microprocessor is further configured to, in response to the charge state of the capacitor not being above the capacitor charge threshold, step the stepper motor if a current line of print data is blank.

18. The thermal printer of claim 17 wherein the microprocessor is further configured to, in response to the charge state of the capacitor not being above the capacitor charge threshold, not step the stepper motor if the current line of print data is not blank.

19. The thermal printer of claim 7 wherein the power converter is a current regulated power converter.

20. The thermal printer of claim 7, further comprising:

a power source voltage feedback circuit coupled to stop a draw of current from the power source when a voltage of the power source drops below a power source voltage threshold.

21. The thermal printer of claim 7, further comprising:

the power source, wherein the power source includes at least one battery cell.

22. The thermal printer comprising:

a thermal print head;

a stepping motor selectively operable to move media with respect to the thermal print head;

a switch;

a capacitor selectively coupleable via the switch to supply power stored in the capacitor to the thermal print head;

a power converter operable to step a voltage from a power source and configured to supply the stepped voltage to the capacitor;

a comparison circuit configured to produce a signal indicative of a comparison between a charge state of the capacitor and a capacitor charge threshold;

a control subsystem configured to cause the thermal print head to print if the signal has a first value, the control subsystem further configured to cause the motor to step if the signal has a second value and if a current line of print data is blank.

23. The thermal printer of claim 22 wherein the capacitor is sufficiently large to concurrently supply power to an entire line of resistive elements of the thermal print head.

24. The thermal printer of claim 22, wherein the control subsystem includes a microprocessor coupled to receive the signal indicative of the comparison, the microprocessor configured to cause the switch to electrically couple the capacitor to the thermal print head in response to the signal having the first value.

25. The thermal printer of claim 24 wherein the microprocessor is further configured to delay printing in response to the signal having the second value.

26. The thermal printer of claim 22 wherein the first value of the signal is produced when the charge state of the capacitor reaches the capacitor charge threshold.

27. The thermal printer of claim 26 wherein the second value of the signal is produced when the charge state of the capacitor is below the capacitor charge threshold.

28. The thermal printer of claim 22 wherein the control subsystem is further configured to cause the motor to not step if the signal has the second value and if the current line of print data is not blank.

* * * * *